US008434640B2

(12) United States Patent
Timm et al.

(10) Patent No.: US 8,434,640 B2
(45) **Date of Patent: *May 7, 2013**

(54) RELEASE SYSTEM FOR CONTAINER

(76) Inventors: Allen G. Timm, Sheboygan, WI (US); Joachim Banik, Oconomowoc, WI (US)

( * ) Notice: Subject to any disclaimer, the term of this patent is extended or adjusted under 35 U.S.C. 154(b) by 493 days.

This patent is subject to a terminal disclaimer.

(21) Appl. No.: 12/559,306

(22) Filed: Sep. 14, 2009

(65) Prior Publication Data

US 2010/0001431 A1 Jan. 7, 2010

Related U.S. Application Data

(63) Continuation of application No. 11/359,021, filed on Feb. 22, 2006, now Pat. No. 7,588,164, which is a continuation-in-part of application No. 10/874,818, filed on Jun. 22, 2004, now Pat. No. 7,806,290.

(51) Int. Cl.

| | |
|---|---|
| ***B65D 43/26*** | (2006.01) |
| ***B65D 43/16*** | (2006.01) |
| ***A45D 33/00*** | (2006.01) |

(52) U.S. Cl.

USPC ..... 220/835; 220/263; 220/4.22; 220/324; 132/293; 206/581; 206/823

(58) Field of Classification Search ..... 220/4.22, 220/4.23, 262, 263, 324, 326, 793, 835; 215/237; 132/293; 206/581, 823

See application file for complete search history.

(56) References Cited

U.S. PATENT DOCUMENTS

| | | | | |
|---|---|---|---|---|
| 1,501,798 | A | | 7/1924 | Morrison |
| 1,686,973 | A | | 10/1928 | Kendall |
| 3,578,203 | A | | 5/1971 | Mainet |
| 3,581,926 | A | | 6/1971 | Roder |
| 4,369,799 | A | | 1/1983 | Napoleon |
| 4,387,730 | A | | 6/1983 | Shioi |
| 4,454,889 | A | | 6/1984 | Contreras, Sr. |
| 4,774,973 | A | | 10/1988 | Gueret |
| 4,863,034 | A | | 9/1989 | Contreras, Sr. |
| 4,917,131 | A | | 4/1990 | Contreras, Sr. |
| 4,972,860 | A | * | 11/1990 | Yuhara et al. ..... 132/301 |
| 5,050,623 | A | | 9/1991 | Yuhara et al. |
| 5,323,902 | A | | 6/1994 | Palmer et al. |
| 5,358,130 | A | | 10/1994 | Mengeu et al. |
| 5,358,151 | A | | 10/1994 | Strasenburgh |

(Continued)

FOREIGN PATENT DOCUMENTS

| | | | |
|---|---|---|---|
| EP | 0992204 | B1 | 3/2004 |
| GB | 2200617 | A | 8/1988 |
| JP | 408191714 | A | 7/1996 |
| JP | 2005052260 | A | 3/2005 |

(Continued)

OTHER PUBLICATIONS

Examiner annotated Figure 6 from US Pat. No. 5,819,764.*

(Continued)

*Primary Examiner* — Anthony Stashick

*Assistant Examiner* — James N Smalley

(74) *Attorney, Agent, or Firm* — Middleton Reutlinger; Chad D. Bruggeman; John F. Salazar

(57) ABSTRACT

A release system for releasably securing a container in a closed position is provided. The release system is integrally formed with a container component that is to be applied to a container. The container component is formed with the release system in a first position, which is later moved to a second position.

22 Claims, 13 Drawing Sheets

U.S. PATENT DOCUMENTS

| | | | | |
|---|---|---|---|---|
| 5,400,912 | A | | 3/1995 | Brown et al. |
| 5,435,456 | A | | 7/1995 | Dubach |
| 5,505,299 | A | | 4/1996 | Ditzig et al. |
| 5,547,091 | A | | 8/1996 | Neveras et al. |
| 5,638,957 | A | | 6/1997 | Brasier |
| 5,819,764 | A | * | 10/1998 | Sussman ..... 132/293 |
| 5,842,486 | A | | 12/1998 | Davis et al. |
| 5,875,942 | A | | 3/1999 | Ohmi et al. |
| 6,129,089 | A | | 10/2000 | Yuhara |
| 6,138,686 | A | | 10/2000 | Yuhara |
| 6,199,559 | B1 | | 3/2001 | Nikolaus et al. |
| 6,283,129 | B1 | | 9/2001 | Yuhara et al. |
| 6,460,712 | B2 | | 10/2002 | Smith et al. |
| 6,510,971 | B1 | | 1/2003 | Martin |
| 2004/0188454 | A1 | | 9/2004 | Tayebi |
| 2004/0217139 | A1 | | 11/2004 | Roth et al. |

OTHER PUBLICATIONS

Push-button release of a type understood to be commercially available and having a deck that is slid under an overhanging element to hide the spring element (two photographs, one sheet), Jan. 26, 2011.

Push-button release of a type understood to be commercially available and having a push-button that is a separate element (two photographs, one sheet), Jan. 26, 2011.

Push-button release of a type understood to be commercially available and having a visible spring element, (two photographs, one sheet), Jan. 26, 2011.

* cited by examiner

RELEASE SYSTEM FOR CONTAINER

CROSS-REFERENCE TO RELATED PATENT APPLICATIONS

The present application is a continuation of U.S. patent application Ser. No. 11/359,021, filed on Feb. 22, 2006, and titled "Release System for Container," which is a continuation-in-part of U.S. patent application Ser. No. 10/874,818, filed on Jun. 22, 2004, and titled "Release System for Container," the full disclosures of which are hereby incorporated herein by reference.

BACKGROUND

The present disclosure relates generally to a container or case for holding an article such as cosmetics. More particularly, the present disclosure relates to a release system capable of releasably securing such a container or case in a closed position. The present disclosure further relates to methods of manufacturing and/or assembling a release system for use with a container.

It is generally known to provide a container or case for holding makeup or cosmetics, such as, powders, eye shadow, eyeliner, lipstick, or other beauty aids. Typically, the container includes a bottom portion for retaining the cosmetic substance and a top portion for retaining the mirror. It is common for the top portion to be pivotally coupled to the bottom portion by a hinge member. Either the top portion or the bottom portion may be pivoted about the hinge to obtain a closed position, thereby providing a convenient storage device. Generally, the top portion and the bottom portion are fastened together in a closed position by a latch that is released by the actuation of a release system.

A generally known release system is the push-button. A user actuates the push-button by applying a force to the push-button which causes the push-button to move in a linear direction. The linear movement of the push-button disengages the latch used to releasably secure the container in the closed position. Push-button release systems are typically positioned along a front edge of the container and are used to latch the top portion of the cosmetic compact to the bottom portion.

It is generally known to provide a push-button release system that uses separate components to provide a push-button release system for a container. A problem with such known release systems is that there is generally an increased cost with such a configuration since the push-button is a separate component requiring it to be made or purchased separate from the rest of the container components. In addition, trying to assemble a push-button that is a separate component is difficult to automate.

Other known containers having push-button like release systems include configurations wherein the release systems are integrally formed with a deck portion of the container. Such configurations often require an undesirable visible gap in an exposed portion of the container system to enable the push-button operate and/or may be difficult to automate because the release system cannot be installed into a container with a single motion.

Thus there is a need for an improved container system having a push-button release system that is inexpensive, simple to assemble, and able to reduce undesirable gaps in the exposed inner surface of the container system. To provide such a container system, it would be advantageous to provide a container component having an integrally formed release system, wherein the release system is formed in one position and then moved to a second position when applied to the container.

It would be desirable to provide a container system having any one or more of these or other advantageous features.

SUMMARY

One embodiment relates to a cosmetic compact including a base, a cover coupled to the base that is moveable relative to the base between a closed position and an open position, a latch configured to selectively retain the cover in the closed position, a container component supported at the base and a release system integrally molded as a one-piece member with the container component. The release system includes a user interface configured to be pressed by a user to release the latch and allow the cover to be moved to the open position.

Another embodiment relates to a method of manufacturing a container including integrally molding a container component and a release system as a one-piece member, molding the release system in a first position, rotating the release system relative to the container component to a second position and coupling the one-piece member to a base with the release system in the second position.

Another embodiment relates to a method of manufacturing a package configured for use with a cosmetic compact including integrally molding a container component and a release system as a one piece member, molding the release system in a first position, rotating the release system relative to the container component to a second position and securing the release system in the second position.

A further understanding of the nature and advantages of the push-button release system disclosed herein may be realized by reference to the remaining portions of the specification and the drawings. It is to be understood that the invention is not limited in its application to the details of construction and the arrangements of components set forth in the following description or illustrated in the drawings.

Figures 6, 6A:
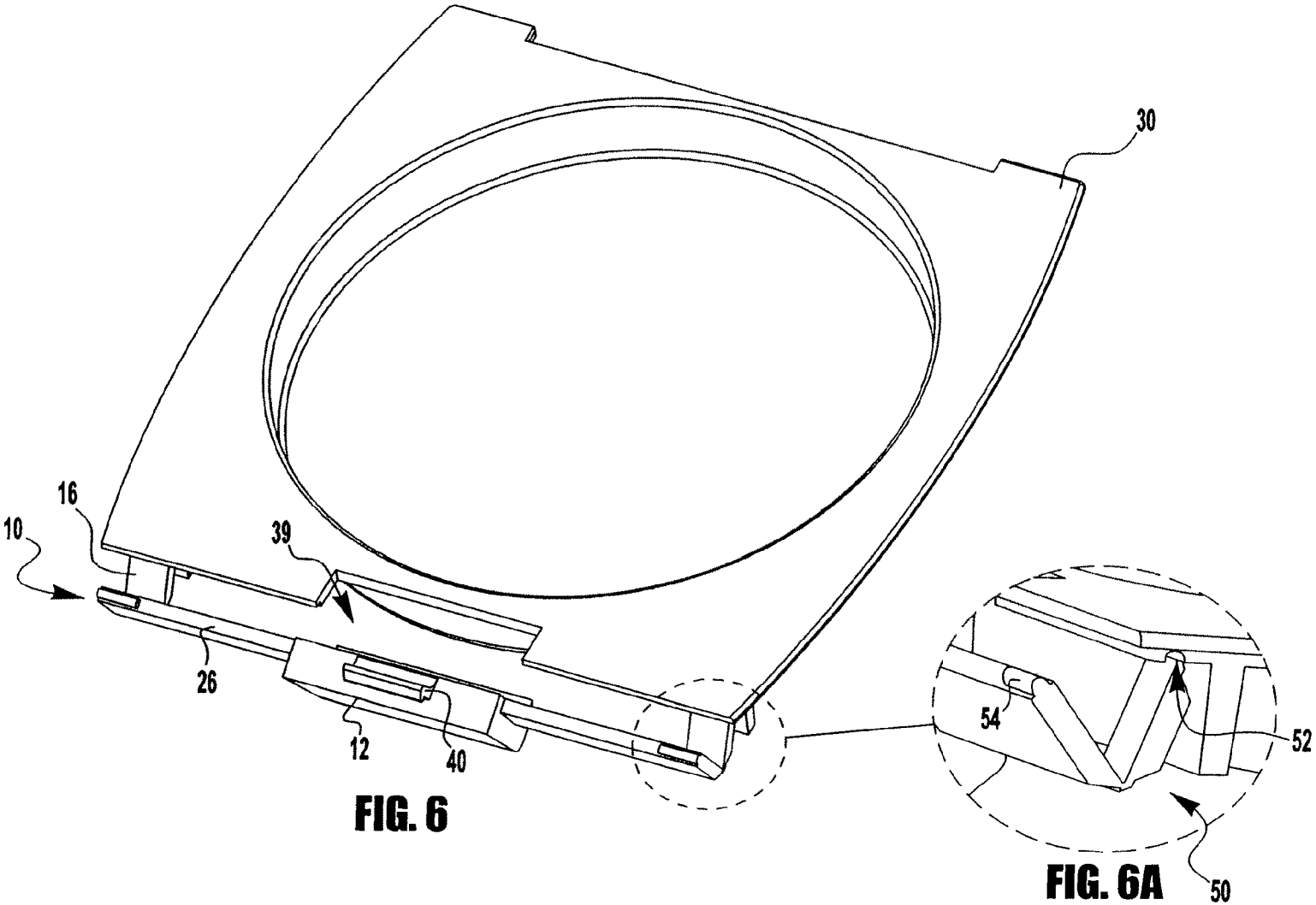
FIG. 6 is a perspective view of a package for use with a container in accordance with an exemplary embodiment, the package includes a release system that is illustrated in a position that is between a first position and a second position.

FIG. **6*a* is a detailed view of the package of FIG. 6** in accordance with an exemplary embodiment.

Figure 7:
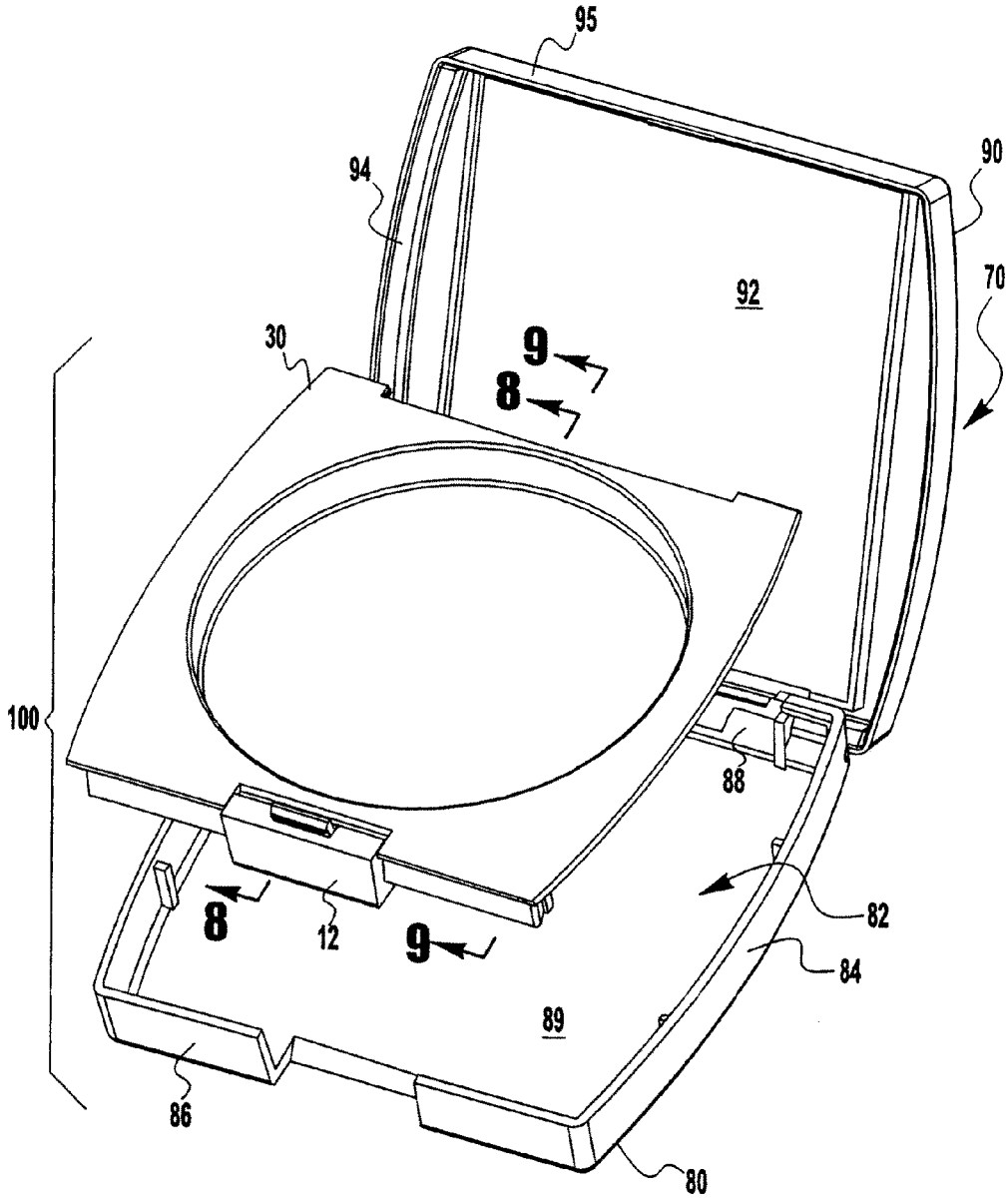

FIG. 7 is a perspective exploded view of a container system in accordance with an exemplary embodiment, the container system includes a release system that is illustrated in a second position.

Figure 8:
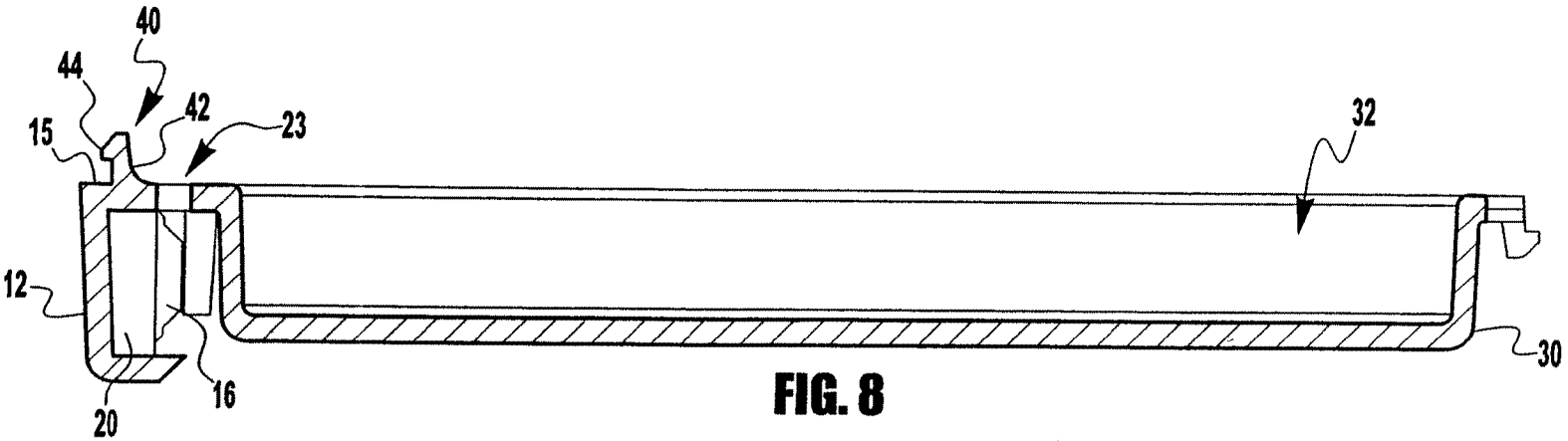

FIG. 8 is a cross sectional view of a package along line 8-8 of FIG. 7 in accordance with an exemplary embodiment.

Figure 9:
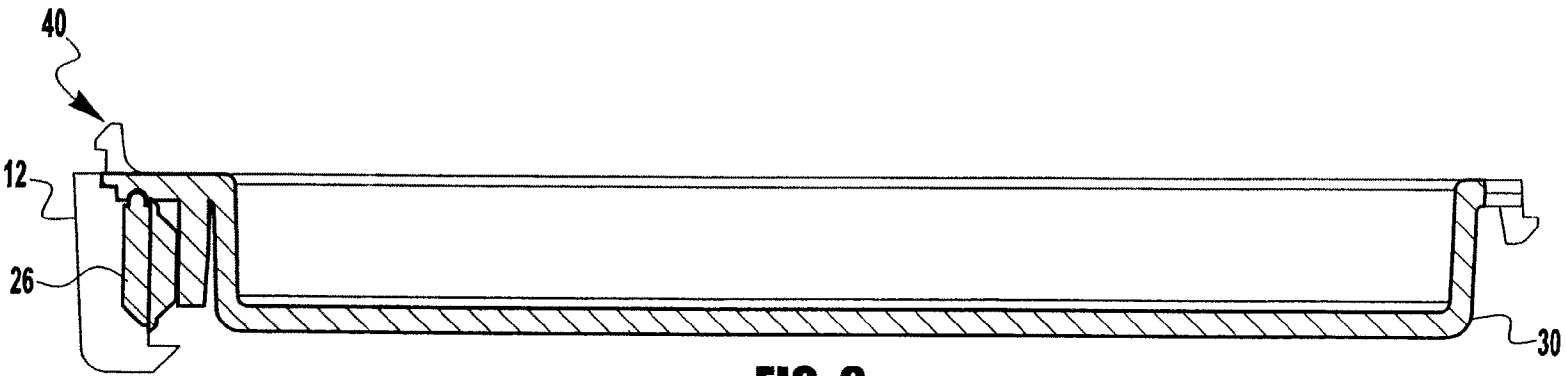

FIG. 9 is a cross sectional view of a package along line 9-9 of FIG. 7 in accordance with an exemplary embodiment.

Figure 10:
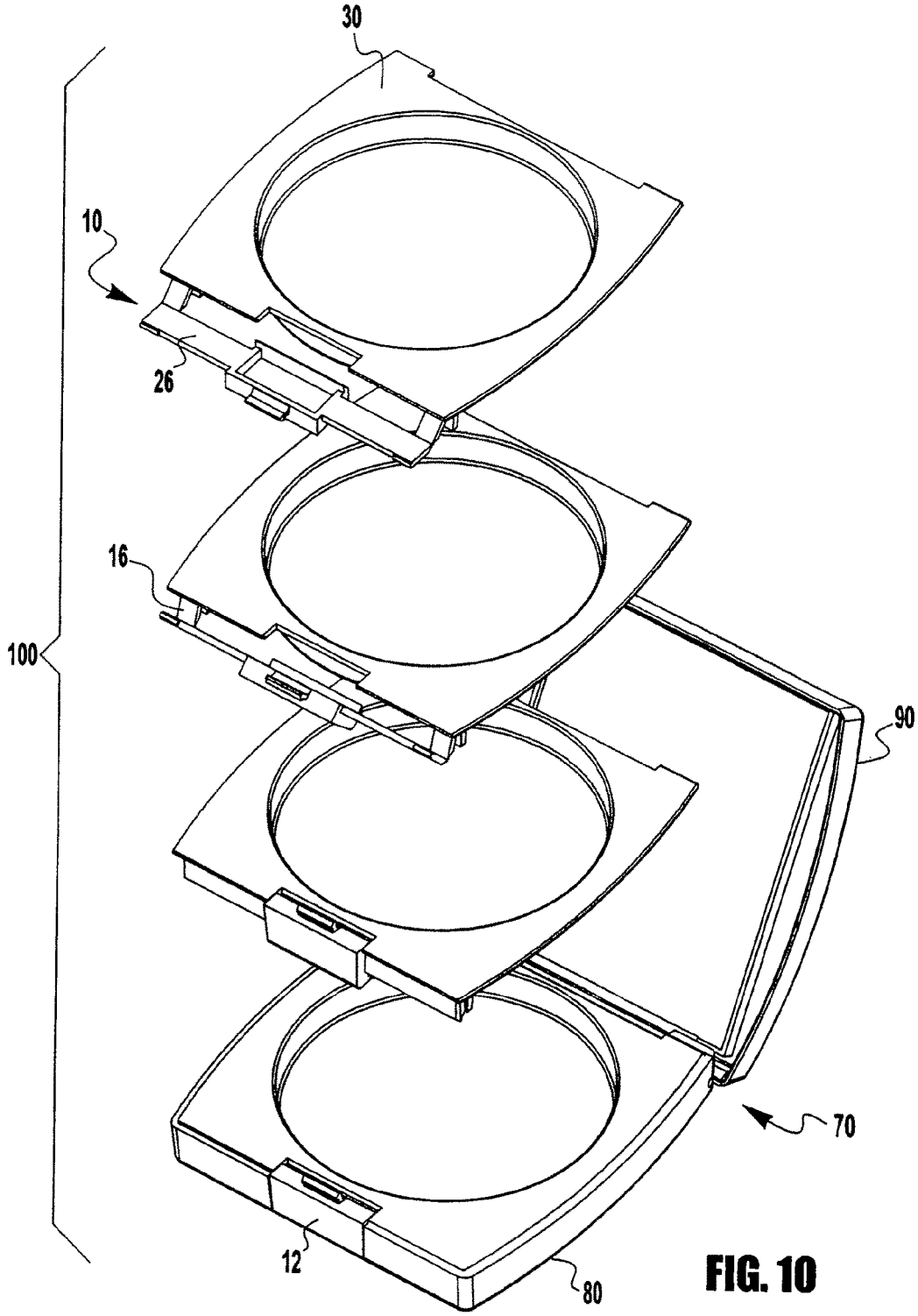

FIG. 10 is a perspective view showing a release system integrally formed with a first platform being applied to a container in accordance with an exemplary embodiment, the release system is shown as moving from a first position to a second position.

Figure 11:
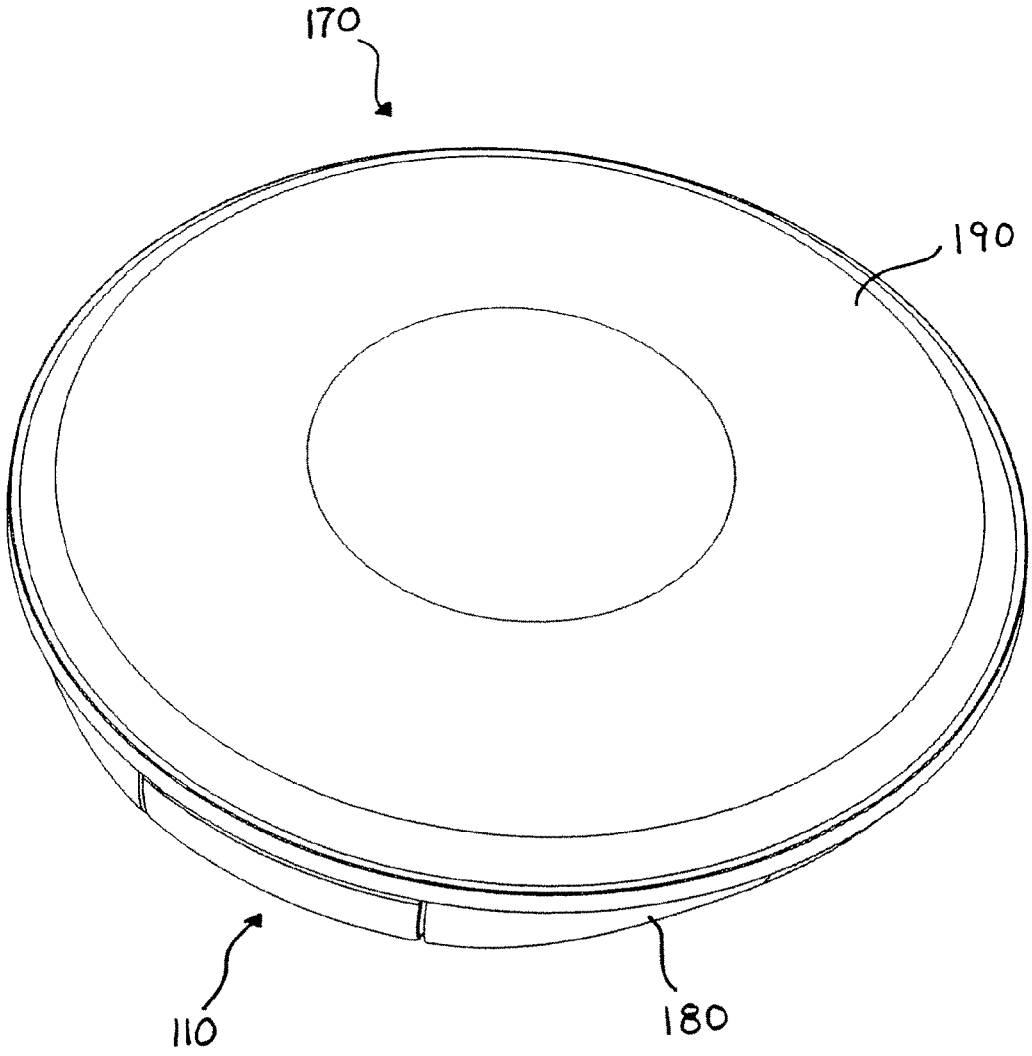

FIG. 11 is a perspective view of a container system in accordance with another exemplary embodiment, the container system is shown in a closed position.

Figure 12:
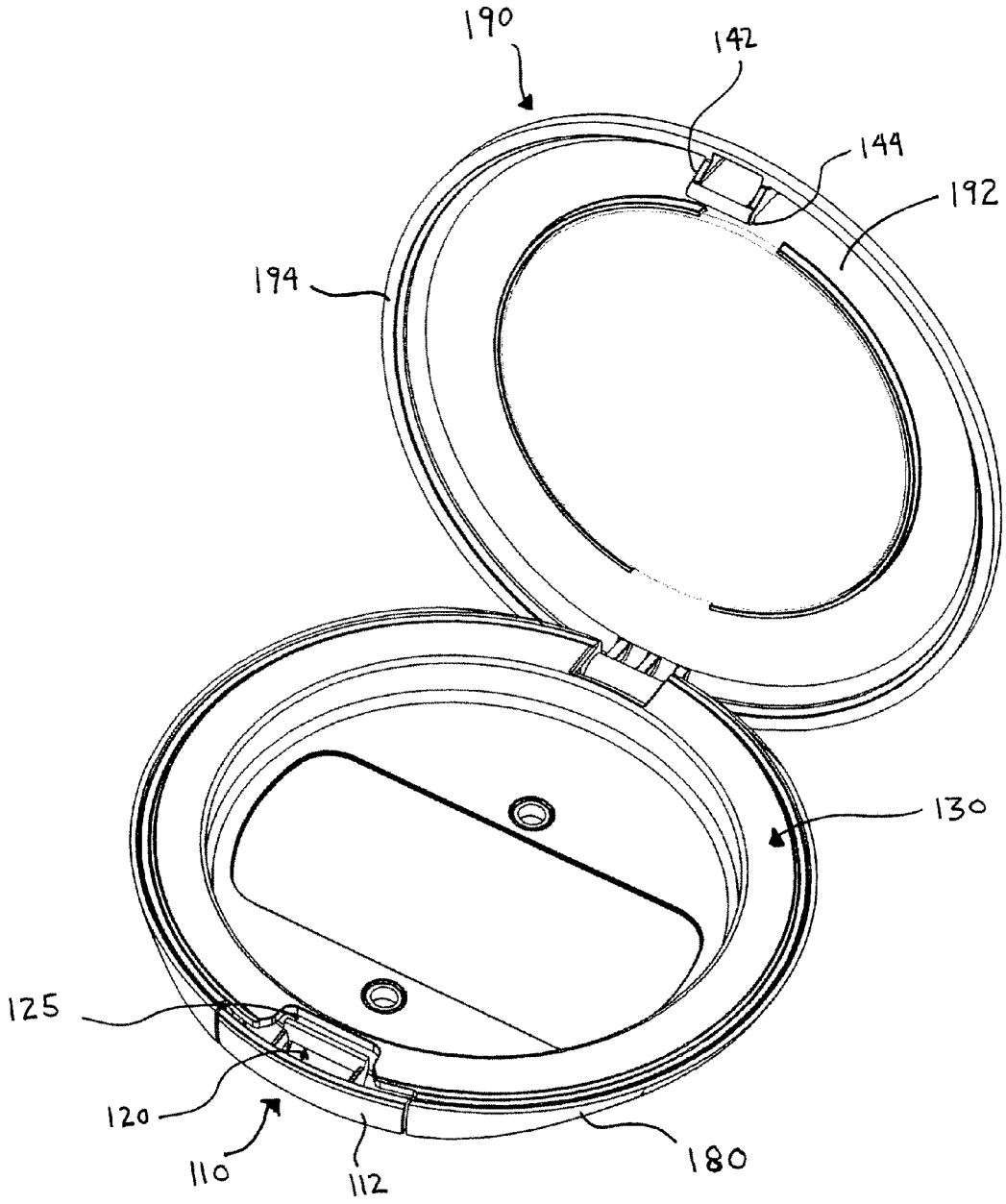

FIG. 12 is a perspective view of the container system of FIG. 11 shown in an open position.

Figure 13:
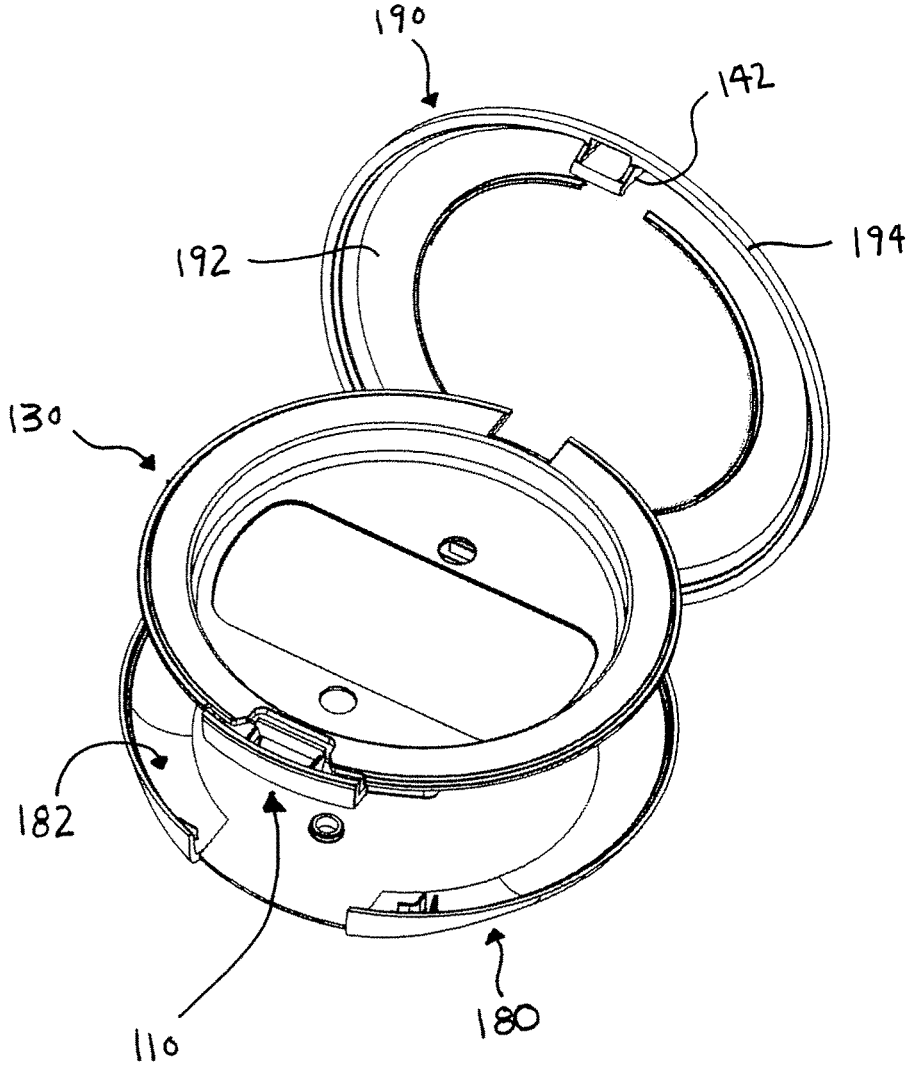

FIG. 13 is a partially exploded perspective view of the container system of FIG. 11.

Figure 14:
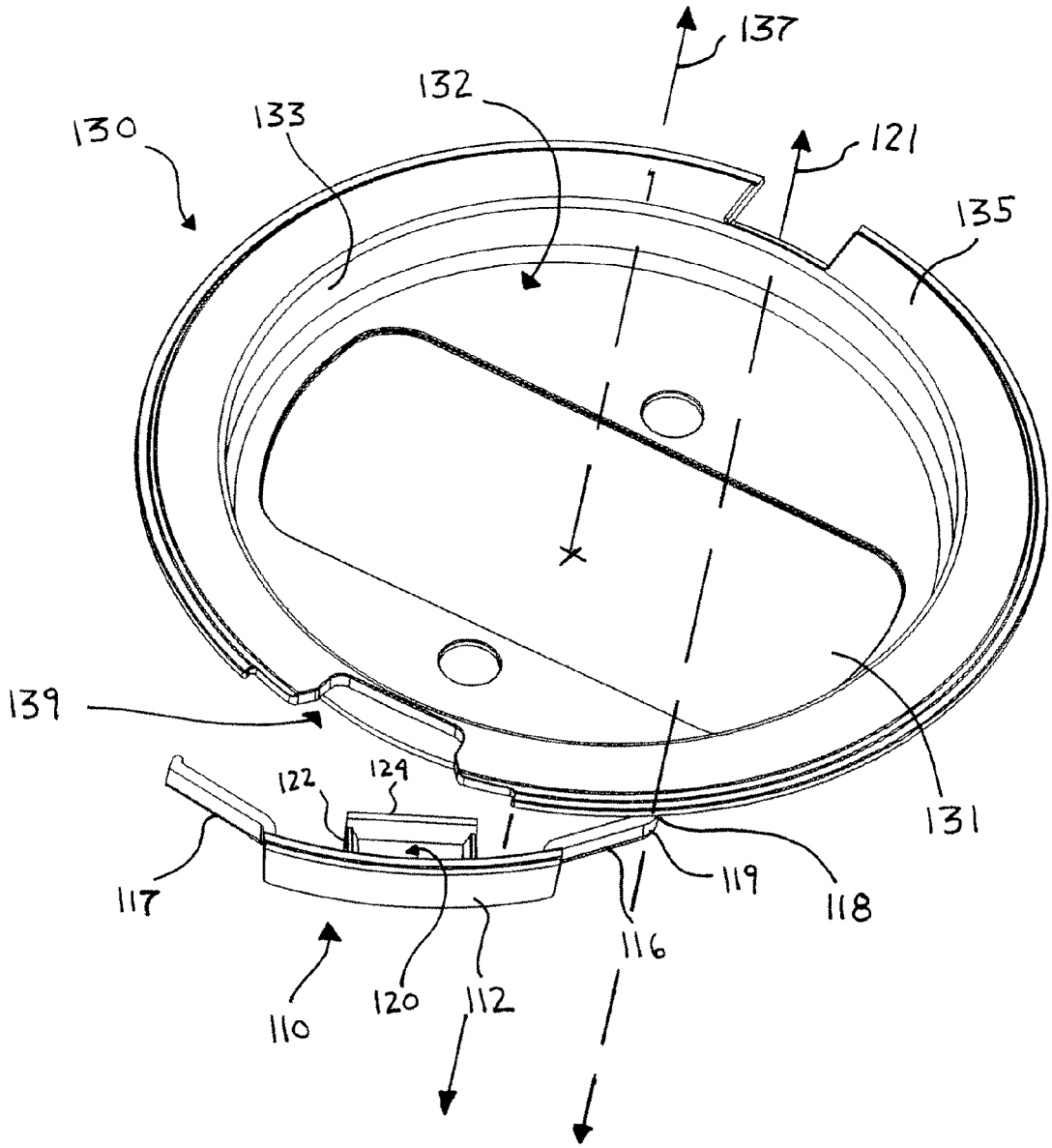

FIG. 14 is a perspective view of a package of FIG. 13 showing a release system in a first position.

Figure 15:
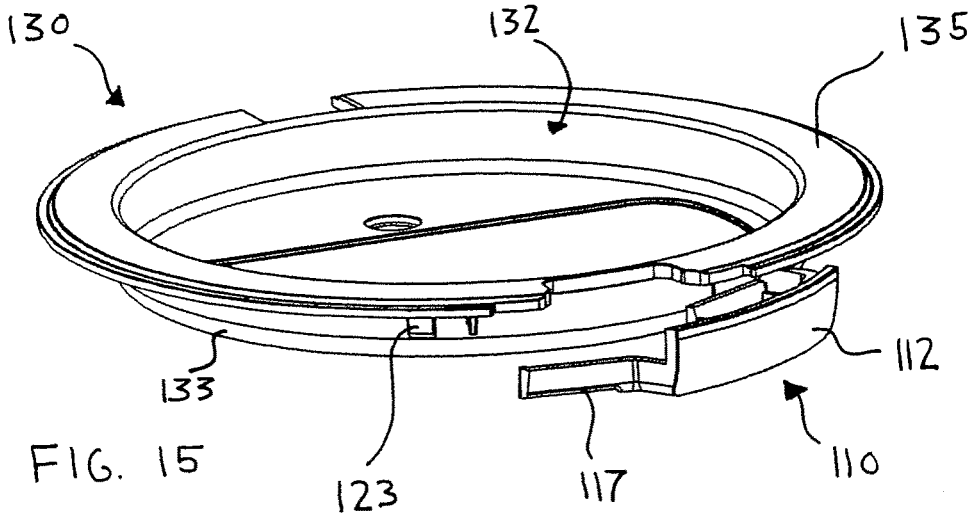

FIG. 15 is another perspective view of the package of FIG. 13 showing the release system in the first position.

Figure 16:
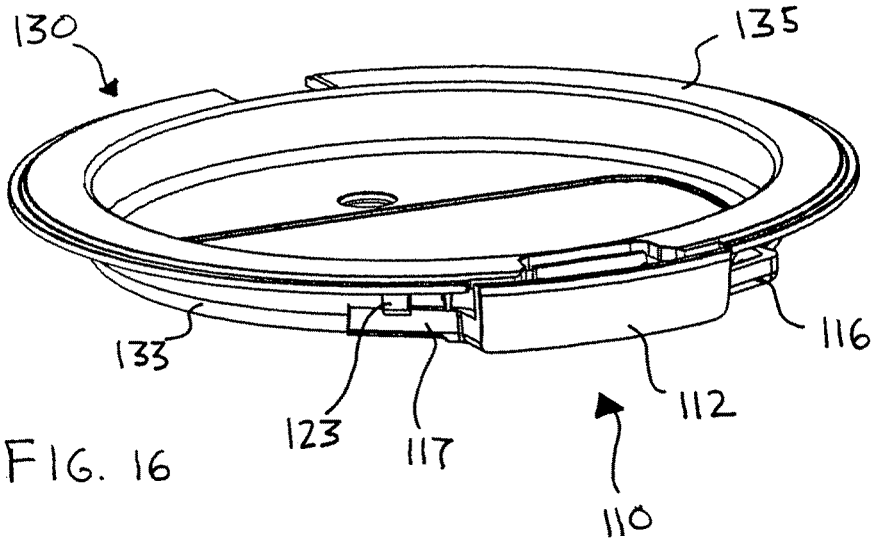

FIG. 16 is another perspective view of the package of FIG. 13 showing the release system in a second position.

Figure 17:
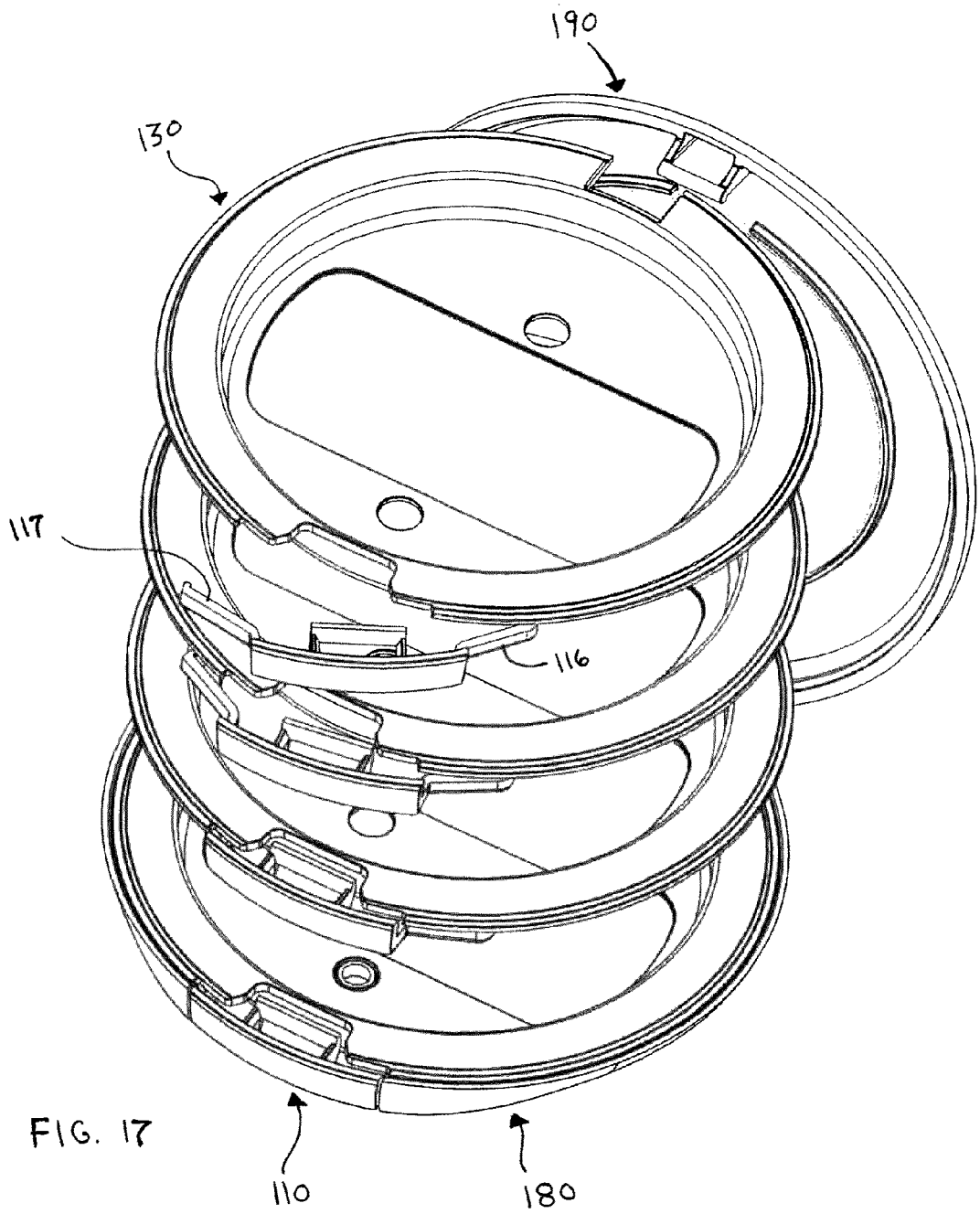

FIG. 17 is a perspective view showing a package being applied to a container in accordance with an exemplary embodiment, a release system is shown moving from a first position to a second position.

DETAILED DESCRIPTION

Before proceeding to a description of the of the preferred and other exemplary embodiments, several general comments may be made about the applicability and the scope thereof.

First, only one particular application for the container systems and/or the release systems is described in detail herein, namely a container system configured to retain a cosmetic substance. It should be understood at the outset that the present inventions have broad applicability to container systems for retaining cosmetic substances, cosmetic applicators, dry and wet tissues, or any other container system where a release system integrally formed with a component of the container (e.g., a first platform) may be used to reduce manufacturing costs, improve the aesthetic appearance of the container system, and/or simplify assembly.

Proceeding now to a description of preferred and other exemplary embodiments, the FIGURES illustrate a release system configured for use with a cosmetic compact (e.g., makeup case) or container for holding a cosmetic substance, such as, foundation, lip gloss, powder, eye shadow, eyeliner, or any other cosmetic substance. As mentioned above, the release system is not limited to use with containers configured to hold cosmetics and may be equally suitable for use with a variety of other container systems.

The release system generally includes a user interface and a linking or link member. The user interface and the link member are integrally formed with a container component (e.g., deck, liner, receptacle, insert, etc.), referred to generally in this disclosure as a first platform, that is supported by the container. The integral combination of the release system and a container component is referred to herein as a "package." The package may constitute a lower or upper portion of a container or may simply be coupled to a lower or upper portion of a container. The release system is formed in a first position (e.g., molded position, etc.) (shown in FIGS. 3 and 14) and moved to a second position (e.g., use position, etc.) (shown in FIGS. 7 and 13) before or as the package is coupled to the container. Providing a release system that is integrally formed with a component of the container advantageously reduces the increased costs commonly associated with container systems having a release mechanism configured as a separate mechanism. Further, providing a release system that is configured to be formed in a first position and is later moved to a second position either before, or as, the package is being coupled to a container advantageously allows for improved aesthetic appearance over conventionally known release systems.

According to a preferred embodiment, the release system is a push-button type release system. The phrase "push-button type release system" is used herein to describe a release system wherein a user actuates the release system by depressing a user interface. Depression of the user interface may allow a top portion, or other portion, of a container to move from a closed storage position to an open use position. According to various alternative embodiments, the release system may be configured as a type of release system other than a push-button type release system.

Referring initially to FIGS. 1 through 10, a release system is shown according to a first exemplary embodiment. In such an embodiment, a release system 10 is shown as being used in conjunction with a substantially rectangular container 70 for providing a means of actuating a cover portion of container 70 relative to a base portion.

Figure 3:
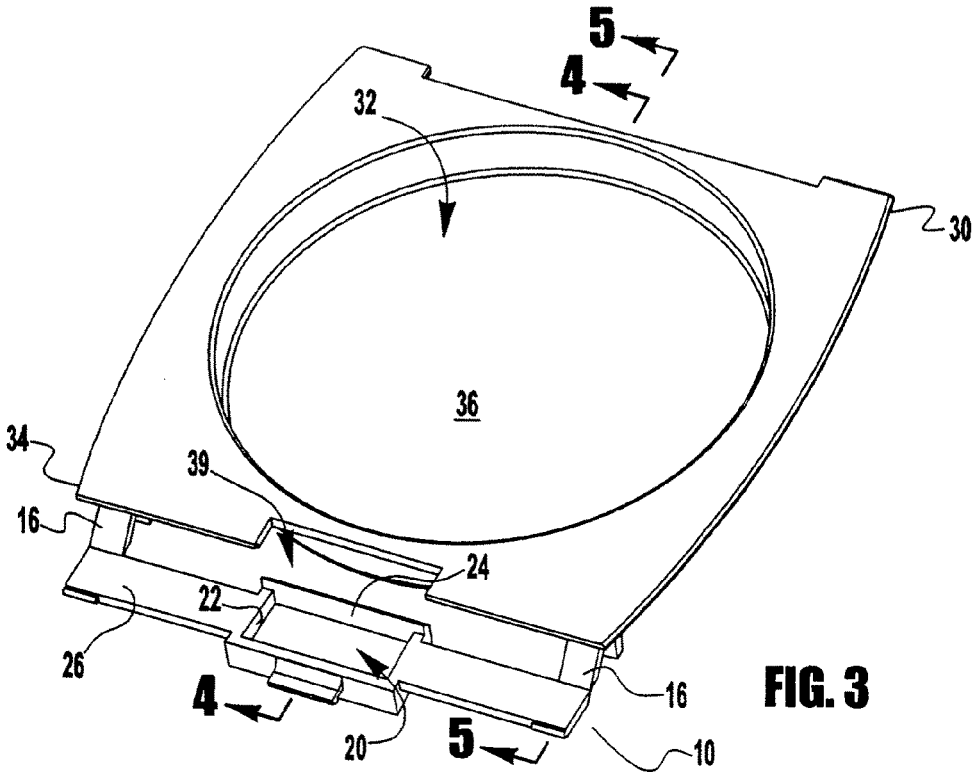
FIG. 3 is a perspective view of a package for use with a container in accordance with an exemplary embodiment, the package is shown as having a release system and a first platform.

Referring particularly to FIG. 3, release system 10 is shown in a first position (e.g., molded position, etc.) and integrally formed with a deck, or first platform 30. First platform 30 is a container component that is configured to be applied to a base or bottom portion of container 70. The integral combination of release system 10 and first platform 30 is referred herein as a "package." As mentioned above, the term "package" may also be used to described a release system that is integrally formed with a container component other than first platform 30.

According to a preferred embodiment, first platform 30 includes a cavity 32 for retaining an article such as a cosmetic substance (e.g., powder, lip gloss, eye shadow, etc.), a cosmetic applicator (e.g., brushes, pens, pencils, etc.), dry or wet tissues, etc. According to various alternative embodiments, first platform 30 may include a plurality of cavities for retaining a combination of articles. According to other alternative embodiments, first platform 30 may not include a cavity 32, and instead may be configured as a substantially flat surface or as having a projection having a receptacle for supporting an article.

First platform 30, together with release system 10, is formed through a molding operation and may be made of a relatively flexible material. Providing a material that is relatively flexible allows for the release system 10 to easily move from a first position to a second or use position. According to various alternative embodiments, one or more of first platform 30 and release system 10 may be made of a relatively rigid material. In such an embodiment, a reduced amount of material may be provided between release system 10 and first platform 30 for allowing release system 10 to move from the first position to the second position.

Injection molded acrylonitrile butadiene styrene ("ABS") is the preferred method and material for making the package, but other materials can be used, including other thermoplastic resins such as, polypropylene, polyurethane nylon, any of a variety of homopolymer plastics, copolymer plastics, plastics with special additives, filled plastics, etc. According to various alternative embodiments, other molding operations may be used to form the first platform 30 and the release system 10, such as compression molding and any other appropriate molding operation.

Figure 4:
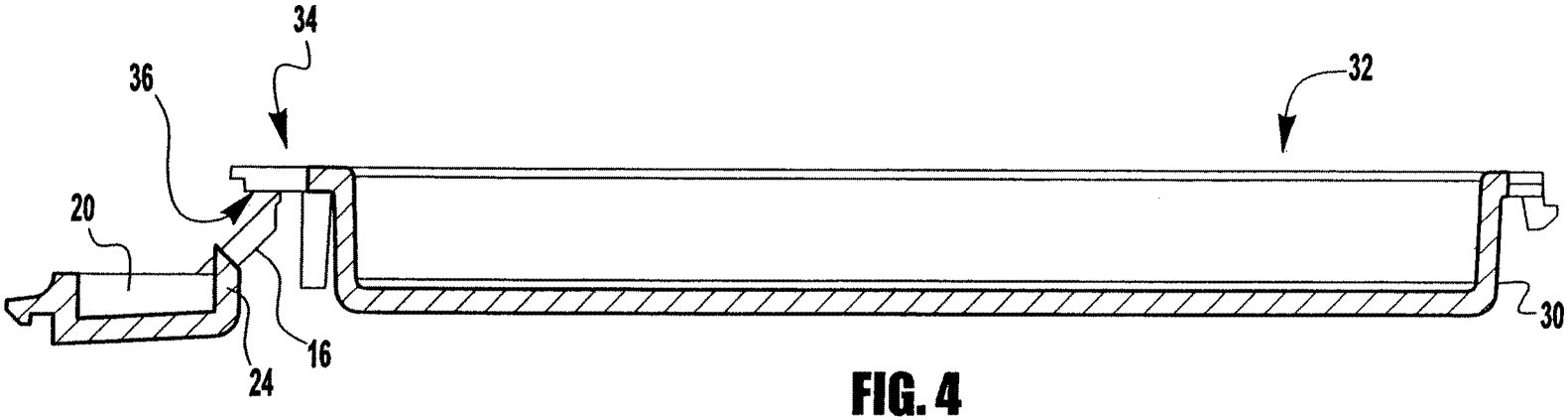
FIG. 4 is a cross sectional view of a package along line 4-4 of FIG. 3 in accordance with an exemplary embodiment.
Figure 5:
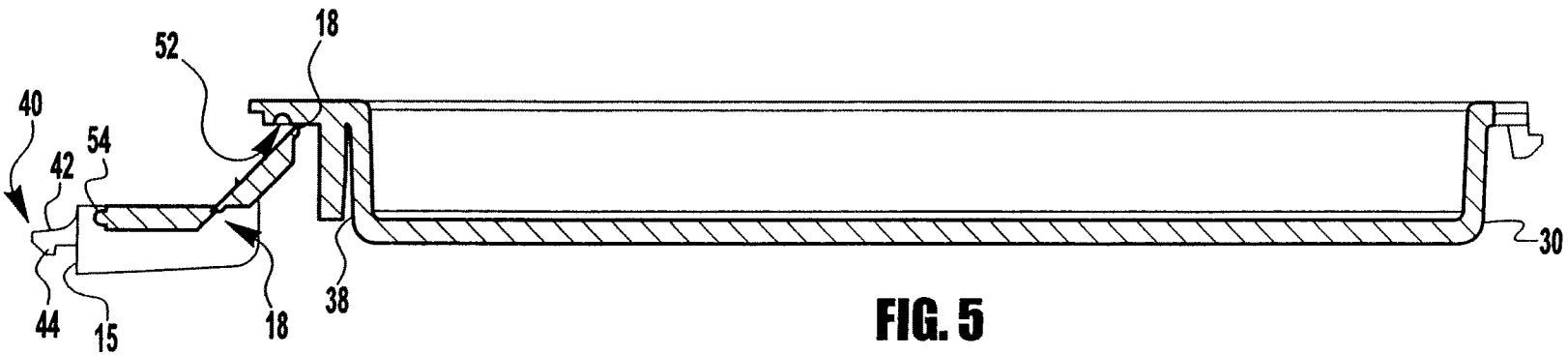
FIG. 5 is a cross sectional view of a package along line 5-5 of FIG. 3 in accordance with an exemplary embodiment.

As shown by FIGS. 4 and 5, release system 10 is preferably positioned near a front portion 34 of the first platform 30. First platform 30 may include a missing or cutout portion 39 for receiving a portion of the release system when rotated into the second position (shown in FIG. 3). First platform 30 may further include a surface that is intended to shield or cover a portion of the release system when the release system is rotated into the second position, thereby allowing undesirable apertures or gaps to be hidden. According to various alternative embodiments, release system 10 may be positioned anywhere along the first platform 30, such as along a side of the first platform or along a rear portion. According to other alternative embodiments, it may be desirable to provide more than one release system for releasably securing a container in a closed position (e.g., a first release system provided on a first side of a container and a second release system provided on a second side of the container, etc.).

As mentioned above, release system 10 generally includes a user interface, and a linking member. Referring further to FIG. 3, release system 10 is shown as including two linking members 16, one positioned near each opposing end of front portion 34 of first platform 30. Preferably linking members 16 are not coupled to a surface of first platform 30 that is exposed to a user when the package is applied to the container 70, but are instead coupled to an unexposed surface such as a bottom surface 36 or a side wall 38 of first platform 30. Coupling linking members 16 to an unexposed surface is intended to hide undesirable lines from the view of a user when the package is applied to the container 70.

According to an exemplary embodiment, linking members 16 are pivotally coupled to first platform 30 and configured to pivot between the first position and second position. Linking members 16 may be pivotally coupled to first platform 30 by a pair of living hinges 18. Living hinges 18 are flexible members providing for the rotation of linking members 16 from the first position to the second position. Living hinges 18 may be integrally formed with linking members 16 and first platform 30.

Figure 2:
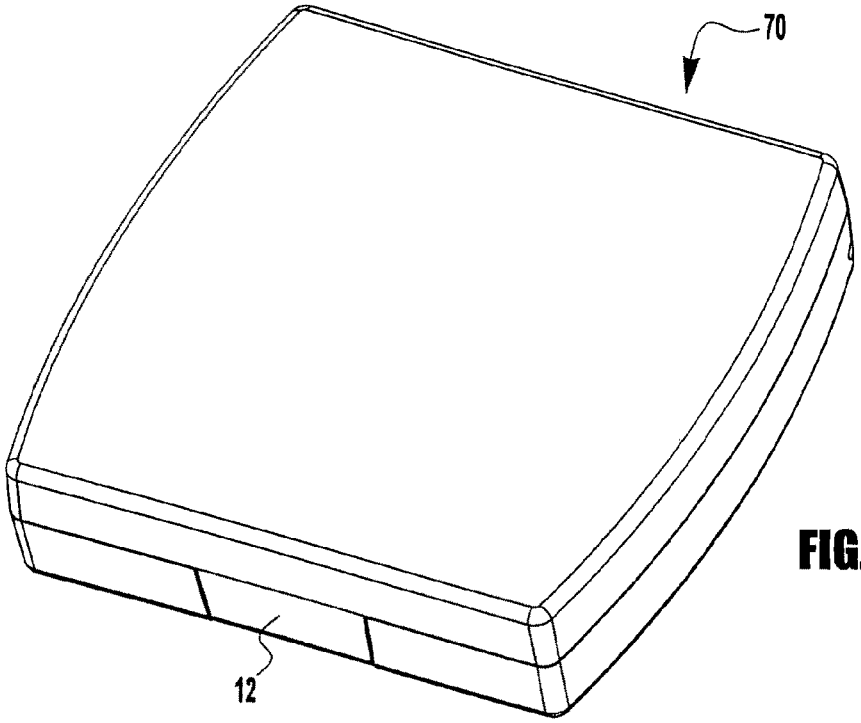
FIG. 2 is a perspective view of container system in accordance with an exemplary embodiment, the container system is shown in a closed position.

Release system 10 further includes the user interface 12 to actuate the release system and thereby enable the container 70 to be moved to an open or use position. According to a preferred embodiment, user interface 12 is a push-button configured to actuate the release system upon being depressed by a user. In the second position, user interface is designed to move in a substantially linear direction when a user applies a sufficient force to the user interface. Referring to FIGS. 2 and 3, user interface 12 is illustrated as a generally rectangular member. According to one embodiment, the user interface may include a back side having an aperture 20 defined by sidewalls 22 and a bottom sidewall 24. As can be appreciated, user interface 12 may be configured in a variety of shapes and sizes. For example, user interface 12 may be a relatively solid member or may be configured as a member having a cutout portion.

Referring to FIG. 6, a gap 23 is provided between user interface 12 and first platform 30. Gap 23 provides room for user interface 12 to move in a linear direction when depressed by a user. According to a preferred embodiment, gap 23 is created by linking member 16 contacting a portion of first platform 30 (shown in FIG. 8). According to various alternative embodiments, gap 23 may be provided by a variety of structures, such as the bottom sidewall 24 contacting a portion of the first platform. User interface 12 is not limited to the push-button configuration illustrated, and may have any of a variety of configurations capable of providing actuation of the release system.

According to a preferred embodiment, release system 10 further includes a support member 26 for supporting user interface 12 in a desired position. In such a configuration, support member 26 is used to couple user interface 12 to first platform 30. Support member 26 may be pivotally coupled to linking members 16 and configured to pivot between the first position and the second position. According to a preferred embodiment, support member 26 is pivotally coupled to linking members 16 by a second pair of living hinges 18. Support member 26 may provide a biasing force that urges the release system into a locked or engaged position when coupled to a container.

To retain container 70 in the closed position (shown in FIG. 2), a locking or latching mechanism 40 is coupled to release system 10. According to a preferred embodiment, and referring to FIG. 8, latching mechanism 40 includes a projection 42 that extends upward from a top surface 15 of user interface 12. The projection 42 may include a lip 44, which can be located at the distal end of projection 42 as shown or intermediate the projection 42. In a configuration of this manner, the lip 44 is configured to releasably engage a portion of the container (e.g., an inside edge of a cover) to maintain the container in a releasably storage or closed position.

According to a preferred embodiment, lip 44 extends or bulges from the projection 42 to form an engagement surface. Lip 44 may include linear edges to form triangular, rectangular, or other polygonal shape as shown most clearly in FIG. 8. Alternatively, lip 44 may include a rounded curvilinear edge extending from projection 42, or may be configured in a variety of shapes combining both linear and nonlinear edges. According to an alternative embodiment, lip 44 may be formed by removing a portion of the projection 42 between its distal end and the top surface of the user interface 12 to which the projection 42 is coupled resulting in a lip 44 that does not bulge outward from the projection 42. In such a configuration, the container portion may include a projection that releasably engages the lip 44.

As mentioned above, release system 10 is integrally formed with a component that is to be applied to the container system 100. According to a preferred embodiment, latching mechanism 40 is also integrally formed with the release system 10 and the first platform 30. Accordingly, the user interface 12, the latching mechanism 40, the support member 26, and the linking members 16, may each be integrally formed with the first platform 30 as a single unitary body (i.e., the package). Release system 10 and first platform 30 are molded in a first position (shown in FIG. 3) which enables the details of the elements to be efficiently formed. According to a particularly preferred embodiment, the elements just mentioned are all made of the same material. For alternative mold operations, more than one material may be used, or the same material in more than one color may be used.

Figure 1:
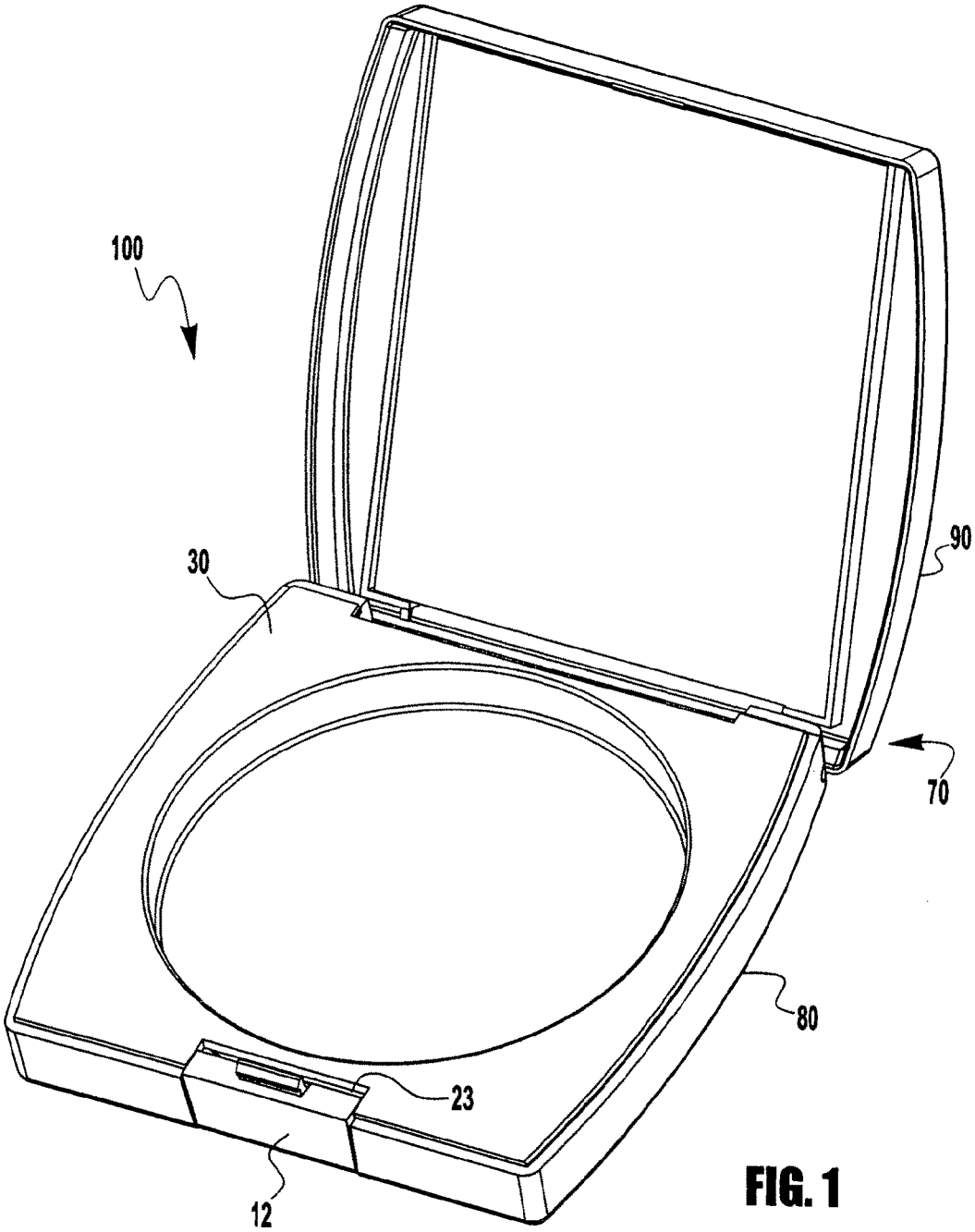
FIG. 1 is a perspective view of container system in accordance with an exemplary embodiment, the container system is shown in an open position.

Subsequent to the formation of the package, release system 10 is moved relative to first platform 30 to the second position which may advantageously hide the biasing element undesirably exposed on known container system having an integrally formed release system (shown in FIG. 1). According to a particularly preferred embodiment, release system 10 is molded in a position approximately 90 degrees from the second position. As release system 10 is moved from the first position to the second position, user interface 12 may be received by cutout portion 39 of first platform 30, and support member 26 may be positioned under front portion 34 of first platform 30. In the second position, the package may be easily applied to a container. In alternative embodiments, release system 10 may be formed in a first position that is rotated an amount other than 90 degrees from the second position.

According to an exemplary embodiment, and referring to FIGS. 6 and 6*a*, a retaining mechanism 50 may be provided that is intended to hold release system 10 in the second position while the package is being applied to a container. In a preferred embodiment, retaining mechanism 50 generally includes a recess 52 formed in front portion 34 of first platform 30 or support member 24, and a projection 54 formed in the other of the front portion or the support member. When release system 10 is moved into the second position, projection 54 engages recess 52 to hold release system 10 in such a position. According to a particularly preferred embodiment, the engagement between projection 54 and recess 52 may be characterized as a snap-fit.

Release system 10 is particularly suitable for use with container system 100 shown in the FIGURES. Container system 100 comprises the combination of a package having a release system 10 with a container 70. According to a preferred embodiment, and referring to FIG. 7, container 70 generally includes an exterior shell having a first portion (e.g., base portion, member, platform, etc.) shown as bottom portion 80, and a second platform (e.g., cover portion, member, lid, etc.) shown as top portion 90. In a closed position, as shown in FIG. 2, the container 70 surrounds an aperture configured to hold an article, such as a cosmetic substance. The aperture may be defined by bottom portion 80 or by top portion 90. Alternatively, the aperture may be partially defined by both the top portion 90 and the bottom portion 80. According to a preferred embodiment, bottom portion 80 includes an aperture 82 configured to receive a package. According to a particularly preferred embodiment, aperture 82 is configured to receive release system 10 and first platform 30. Aperture 82 may be formed by side walls 84, a front wall 86 and a back wall 88 extending upward from a base 80.

The container 70, including bottom portion 80, may be configured in a wide variety of shapes to accommodate the needs of the particular application. According to the embodiment illustrated in FIGS. 1 through 10, container 70 is configured as having a generally rectangular shape. According to various alternative embodiments, container 70 may be configured into other well known shapes, including asymmetrical shapes.

Top portion 90 may be configured to cover the aperture 82 and enclose the retained articles when in the closed position shown in FIG. 2. Top portion 90 may be defined by a cover surface 92 and a peripheral wall 94 extending downward from cover surface 92. Preferably, peripheral wall 94 includes a groove, protrusion, chamfer or any other engaging surface along its distal end configured to releasably engage the latching mechanism 40 integral with the package. According to a particularly preferred embodiment, a rib is positioned along the distal edge of a front peripheral wall 95. As top portion 90 is moved from an open position to a closed position, the rib cams lip 44 and projection 42 of latching mechanism 40 into an engaging closed position. Top portion 90 may be disengaged from the closed position by depressing user interface 12 thereby releasing latching mechanism 40 from the rib.

Top portion 90 may be independent from bottom portion 80 or alternatively fixedly coupled relative to the bottom portion. The term "independent" as used herein is intended to describe a configuration wherein when container 70 is in an open position, the top portion 90 is not coupled to the bottom portion 80. Accordingly, the term "fixedly coupled" as used herein is intended to describe a configuration wherein when the top portion 90 is moved to the open position, the top portion is intended to remain at least partially attached to the bottom portion 80.

According to a preferred embodiment, top portion 90 is fixedly coupled to the bottom portion 80. The top portion 90 may be fixedly coupled to the bottom portion 80 by being integral with the bottom portion 80 (e.g., fixedly coupled by means of a living hinge) or attached to the bottom portion 80 through an attachment system (not shown). According to a particularly preferred embodiment, container 70 is a clamshell type container wherein top portion 90 is pivotally coupled to bottom portion 80 by the attachment system. According to a preferred embodiment, the attachment system includes a pivot shaft or rod coupled to at least one of top portion 90 and bottom portion 80, and a corresponding slot or recess formed in the other of top portion 90 and bottom portion 80. The pivot rod functions as a pivot point and is inserted into the recess thereby securing top portion 90 with bottom portion 80 while providing pivotal rotation of top portion 90 relative to bottom portion 80. As can be appreciated, the attachment system may be provided by a variety of generally known or otherwise appropriate attachment configurations including, but not limited to, a mechanical hinge.

A method of manufacturing the container system 100 according to a preferred embodiment includes the steps of forming a package comprising the first platform 30, the release system 10, and the latching mechanism 40 and applying the package to the container 70. The step of forming the package includes the step of integrally molding the user interface 12, the linking member 16, the support member 26, the latching mechanism 40, and the first platform 30 in a first position wherein the user interface 12 is at a positioned approximately 90 degrees rotated from the second position. The method further includes the step of configuring linking member 16 to be movably coupled to the first platform 30. The step of configuring linking member 16 to be movably coupled to the first platform 30 may include providing a living hinge between the linking member 16 and the first platform 30.

Referring to FIG. 10, the step of applying the package to the container 70 includes moving release system 10 from the first position to the second position. According to a preferred embodiment, this step involves pivotally rotating user interface 12 approximately 90 degrees so that the top surface of user interface 12 is substantially parallel with the top surface of first platform 30. Preferably, user interface 12 will be received by the cutout portion 39 of first platform 30 and support member 26 is at least partially concealed under the front portion 34 of first platform 30. According to a preferred embodiment, a retaining mechanism 50 is provided to hold release system 10 in the second position. Once user interface 12 has been moved into the second position, the first platform 30 and the release system 10 may be easily received by the bottom portion 80 of container 70.

As can be appreciated, the assembly of the package and container 70 may be automated in such a manner that as the package is being inserted into the bottom portion 80 of the container 70, a portion of the container cams the release system 10 into the second position. Preferably, the step of applying the package to the container 70 includes inserting the package into container 70 in one motion. According to a particularly preferred embodiment, the step involves moving (e.g., dropping, placing, inserting, etc) the package in one vertical motion from a position above bottom portion 80 of container 70 into aperture 82 defined by sidewalls 84. Once first platform 30 and release system 10 are inserted, the method may include a further step of fastening the first platform 30 to the bottom portion 80. This step may include applying a snap fit between the bottom portion 80 and the first platform 30, or may include welding, frictionally engaging, applying adhesive, or applying a mechanical fastener.

Referring next to FIGS. 11 through 17, a container and a release system are shown according to a second exemplary embodiment. The container is shown as a container 170, while the release system is shown as a release system 110. For convenience, elements of release system 110 and container 170 that are similar to corresponding elements of release system 10 and container 70 will be identified by the same reference numerals but preceded by a "1."

Referring to FIGS. 11 through 13 in particular, container 170 comprises a first portion (e.g., base, etc.), shown as a bottom portion 180, and a second portion (e.g., lid, cover, etc.), shown as a top portion 190. Bottom portion 180 and top portion 190 cooperate to provide a conveniently sized storage system suitable for holding an article, such as a cosmetic substance (e.g., pressed powder, etc.). According to the embodiment illustrated, container 170 is a substantially round or circular container that is preferably sized to fit conveniently into a user's bag, purse, pocket, etc. For example, container 170 may have a diameter between around one inch and around four inches. According to various alternative embodiments, container 170 may have a diameter less than one inch or greater than four inches.

Referring to FIG. 13, bottom portion 180 is configured to support the article to be retained by container 170. According to the embodiment illustrated, bottom portion 180 defines an aperture 182 for receiving such an article (either directly or indirectly). Top portion 190 is configured to cover aperture 182 and enclose the retained article when in a closed position shown in FIG. 11. According to the embodiment illustrated, top portion 190 is defined by a cover surface 192 and a peripheral wall 194 extending downward from cover surface 192. Top portion is configured to be selectively moved by a user between the closed position and an open position (shown in FIG. 12). To selectively move top portion 190 to the open position, a user must first actuate release system 110.

Top portion 190 may be independent from bottom portion 180 or alternatively fixedly coupled relative to the bottom portion. The term "independent" as used herein is intended to describe a configuration wherein when container 170 is in the open position, top portion 190 is not coupled to bottom portion 180. Accordingly, the term "fixedly coupled" as used herein is intended to describe a configuration wherein when container 170 is in the open position, top portion 190 is intended to remain at least partially attached to bottom portion 180.

According to the embodiment illustrated, top portion 190 is fixedly coupled to bottom portion 180. Top portion 190 may be fixedly coupled to bottom portion 180 by being integral with bottom portion 180 (e.g., fixedly coupled by means of a living hinge, etc.) or attached to bottom portion 180 through an attachment system. According to a preferred embodiment, container 170 is a clam-shell type container wherein top portion 190 is pivotally coupled to bottom portion 180 by the attachment system. According to a particularly preferred embodiment, the attachment system includes a pivot shaft or rod coupled to at least one of top portion 190 and bottom portion 180, and a corresponding slot or aperture formed in the other of top portion 190 and bottom portion 180. The pivot rod functions as a pivot point and is inserted into the aperture thereby securing top portion 190 with bottom portion 180 while providing pivotal rotation of top portion 190 relative to bottom portion 180. As can be appreciated, the attachment system may be provided by a variety of generally known or otherwise suitable attachment configurations including, but not limited to, a mechanical hinge.

According to the embodiment illustrated, bottom portion 180 is configured to receive a container component (e.g., deck, liner, insert, etc.), shown as a first platform 130, within aperture 182. Referring to FIG. 14, first platform 130 includes one or more cavities (shown as a single cavity 132) for receiving the article to be retained. Cavity 132 is defined by an end wall 131 (e.g., platform, bottom surface, etc.) and a side wall 133 (e.g., peripheral surface, etc.) extending upward therefrom at an orientation that is generally perpendicular to the end wall 131. Side wall 133 is cylindrical and is concentrically aligned with a longitudinal axis 137 of first platform 130. According to the embodiment illustrated, cavity 132 has a cross section that is substantially circular in shape. According to various alternative embodiments, cavity 132 may have any of a number of suitable shapes or configurations. Outwardly extending from a free end of side wall 133 at an orientation that is generally parallel with the end wall 131 is a flange 135 (e.g., platform, ledge, lip, etc.). Flange 135 may extend substantially continuously about the free end of side wall 133 (as shown), or alternatively, may be provided intermittently or only at a particular portion of the free end of side wall 133 (e.g., a front portion of the container.

Integrally formed with first platform 130 is release system 110. Release system 110 provides a means of actuating top portion 190 of container 170 relative to bottom portion 180. Release system 110 is formed in a first position (e.g., molded position, etc.) (shown in FIG. 14) and later moved to a second position (e.g., use position, etc.) (shown in FIG. 13) before or as the package is coupled to container 170. Similar to the embodiment described with reference to FIGS. 1 through 10, the integral combination of release system 110 and first platform 130 is referred to herein as a "package."

Referring further to FIG. 14, release system 110 is shown as including two link members 116 and 117 outwardly extending from a user interface 112. The user interface 112 is a "push-button" interface configured to be depressed by a user to actuate release system 110 and thereby enable container 170 to be moved from the closed position to the open position. User interface 112 is illustrated as a generally rectangular member having a peripheral surface which is curved to match or otherwise correspond to the shape of bottom portion 180 (as shown in FIG. 12). According to various alternative embodiments, user interface 112 may be configured in a variety of suitable shapes and sizes depending on the configuration of the container or various design criteria.

Link member 116 includes a second end 119 that is coupled to platform 130. Preferably link member 116 is not coupled to a surface of first platform 130 that is exposed to a user when the package is applied to container 170, but is instead coupled to an unexposed surface. According to the embodiment illustrated, second end 119 is coupled to a outer portion of sidewall 133 and concealed from view by flange 135. Coupling link member 116 to an unexposed surface is intended to hide undesirable lines from the view of a user when the package is applied to container 170.

Link members 116 is pivotally coupled to first platform 130 and configured to rotate about an axis 121 between the first position and the second position. According to the embodiment illustrated, axis 121 is a substantially vertical axis that extends substantially parallel with axis 137. Link member 116 is pivotally coupled to first platform 30 by a living hinge 118. Living hinge 118 is a flexible member providing for the rotation of link member 116 from the first position to the second position. Living hinge 118 is integrally formed with link member 116 and first platform 130.

Referring to FIG. 16, once link member 116 is rotated to the second position, a second end of link member 117 contacts or is positioned near the outer portion of sidewall 133. To assist in retaining link member 117 in such a position, a retaining mechanism (e.g., latch, clasp, projection, cam, etc.), shown as a tab 123, is provided. Tab 123 outwardly extends from the outer portion of side wall 133 and/or a bottom surface of flange 135. As release system 110 is being rotated about axis 121, a portion of link member 117 snaps-over or otherwise engages tab 123. Tab 123 is configured to assist in retaining link member 117 proximate to sidewall 133. According to various alternative embodiments, the retaining mechanism may have any suitable of configurations suitable for retaining release system in the second position.

Referring further to FIG. 12, a gap 125 is provided between user interface 112 and first platform 130. Gap 125 provides room for user interface 112 to move in a linear direction when depressed by a user. According to a preferred embodiment, gap 125 is created by the configurations of link members 116 and 117.

To retain container 170 in the closed position, a locking or latching mechanism 140 is coupled to release system 110. According to the embodiment illustrated, with reference to FIGS. 12 and 14, latching mechanism 140 includes an aperture 120 defined by user interface 112. Aperture 120 is provided at a backside of user interface 112 and is defined by the back surface of user interface 112, a pair of spaced-apart sidewalls 122, and a rear wall 124. Aperture 120 is configured to receive a projection 142 downwardly extending from top portion 190 of container 170. Projection 142 may include a lip 144, which can be located at the distal end of projection 142 as shown or intermediate the projection 142. In a configuration of this manner, lip 144 is configured to releasably engage aperture 120 to maintain the container in a releasably storage or closed position.

According to a preferred embodiment, lip 144 extends or bulges from projection 142 to form an engagement surface. Lip 144 may include linear edges to form triangular, rectangular, or other polygonal shape. Alternatively, lip 144 may include a rounded curvilinear edge extending from projection 142, or may be configured in a variety of shapes combining both linear and nonlinear edges. According to an alternative embodiment, lip 144 may be formed by removing a portion of projection 142 between its distal end and top portion 190 to which projection 142 is coupled resulting in a lip 144 that does not bulge outward from projection 142. In such a configuration, user interface 112 (and particularly rear wall 124) may include a projection that releasably engages lip 144.

As mentioned above, release system 110 is integrally formed with first platform 130. According to an exemplary embodiment, release system 110 and first platform 130 are formed via a molding operation. In such an embodiment, release system 110 and first platform 130 are molded in the first position (shown in FIG. 14) which enables the details of the elements to be efficiently formed. According to a particularly preferred embodiment, the elements just mentioned are all made of the same material. For alternative mold operations, more than one material may be used, or the same material in more than one color may be used.

Subsequent to the formation of the package (e.g., the combination of first platform 130 and release system 110, etc.), release system 110 is moved relative to first platform 130 (about axis 121) to the second position (shown in FIG. 13). According to an exemplary embodiment, release system 110 is molded in a position between approximately 5 degrees and approximately 90 degrees from the second position. According to various alternative embodiments, release system 110 may be molded in any number of positions relative to the second position. As release system 110 is moved from the first position to the second position, user interface 12 may be received by a cutout portion 139 (shown in FIG. 14) provided in flange 135 of first platform 130, and link members 116 and 117 may be positioned under flange 135. In the second position, the package may be easily applied to a container.

A method of manufacturing a container system (the combination of the container and the package) according to an exemplary embodiment includes the steps of forming a package comprising first platform 130, release system 110, and latching mechanism 140 and applying the package to container 170. The step of forming the package includes the step of integrally molding user interface 112, link member 116, and first platform 130 in a first position wherein user interface 112 is at a position different (e.g., angularly displaced, etc.) than the second position. The method further includes the step of configuring link member 116 to be movably coupled to first platform 130. The step of configuring link member 116 to be movably coupled to first platform 130 may include providing a living hinge between link member 116 and first platform 130.

Referring to FIG. 17, the step of applying the package to container 170 includes moving release system 110 from the first position to the second position. According to the embodiment illustrated, this step involves rotating link member 116 (and thus user interface 112) about axis 121 (shown in FIG. 14) until second link member 117 is proximate sidewall 133. In this manner, the entire release system 110 remains in the same horizontal plane as it rotates about axis 121. Preferably, user interface 112 will be received by cutout portion 139 of flange 135 and link members 116 and 117 will be at least partially concealed under flange 135. Once user interface 112 has been moved into the second position, first platform 130 and release system 110 may be easily received by bottom portion 180 of container 170.

The assembly of the package and container 170 may be automated in such a manner that as the package is being inserted into bottom portion 180 of container 170, a portion of the container urges release system 110 into the second position. Preferably, the step of applying the package to container 170 includes inserting the package into container 170 in one motion. According to a particularly preferred embodiment, the step involves moving (e.g., dropping, placing, inserting, etc) the package in one vertical motion from a position above bottom portion 180 of container 170 into aperture 182. Once first platform 130 and release system 110 are inserted, the method may include a further step of fastening first platform 130 to bottom portion 180. This step may include applying a snap fit between bottom portion 180 and first platform 130, or may include welding, frictionally engaging, applying adhesive, or applying a mechanical fastener.

It is important to note that the construction and arrangement of the elements of the container and the first platform having an integrally formed release system 10 as shown in the exemplary embodiment are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the release system is not limited to a push-button type release system as shown, and may be any type of release system that is formed in a first position and then rotated into a second position. Further, as mentioned above, first platforms 30 and 130 may be configured to have a plurality of cavities for holding a variety of cosmetic substances. Further still, first platforms 30 and 130 may be configured to hold articles, other than cosmetic substances. For example, first platforms 30 and 130 may include cavities for supporting a mirror, a cosmetic applicator (e.g., a brush, pencil, tweezers, pad, sponge, etc.), tissues, etc. The container system may include a plurality of platforms or tiers, and the release system may be integrally formed with any such platform. Further, while the embodiment illustrated in FIGS. 1 though 10 include a release system that is molded at a position approximately 90 degrees rotated from a use position, alternative embodiments may mold the release system at a position greater or less than 90 degrees rotated from the use position. In addition, while the exemplary embodiment illustrated in FIGS. 11 through 17 include a release system that is molded at a position between approximately 5 degrees and approximately 90 degrees rotated from the second or use position, alternative embodiments may mold the release system at a position less than 5 degrees or greater than 90 degrees rotated from the second position. Further still, the configuration of the release system illustrated in FIGS. 1 through 10 is not limited to use with containers and/or container components that are rectangular in shape. Likewise, the release system illustrated in FIGS. 11 through 17 is not limited to use with container and/or container components that are circular in shape. The release systems disclosed herein are suitable for use with container and/or container components having any of a number of shapes (e.g., octagonal, triangular, curvilinear, combination of linear edges and curvilinear edges, etc.).

Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the present invention as expressed in the appended claims.

What is claimed is:

1. A cosmetic compact comprising:

a base;

a cover coupled to said base and moveable relative to said base between a closed position and an open position;

a latch configured to selectively retain said cover in said closed position;

a container component supported at the said base;

a release system integrally molded as a one-piece member with said container component in a first position and later rotated to a second position about a hinge relative to said container component before said container component is supported at said base, said release system having a distal end opposite said hinge, wherein said distal end of said release system is in an engaged position with said container component when in said second position and said distal end of said release system is in a disengaged position with said container component when in said first position, said release system including a user interface configured to be pressed by a user when in said second position to release said latch and allow said cover to be moved to said open position;

wherein said release system is integrally molded with said container component at an axis of said hinge about which said release system is configured to rotate before said container component is supported at said base; and wherein said release system is restricted from rotating about said axis after said container component is supported at said base.

2. The cosmetic compact of claim 1 wherein said base includes a sidewall defining an aperture configured to receive said container component and having a longitudinal axis that is substantially parallel to said sidewall, said longitudinal axis being substantially parallel to said axis.

3. The cosmetic compact of claim 1 wherein said cover is coupled to said base at a pivot axis about which said cover is rotatable relative to said base between said closed position and said open position, said pivot axis being substantially parallel to said axis.

4. The cosmetic compact of claim 1 wherein said container component defines an aperture configured to support a cosmetic substance.

5. The cosmetic compact of claim 4 wherein said aperture is substantially concealed by said cover when said cover is in said closed position.

6. A cosmetic compact:

a base;

a cover coupled to said base and moveable relative to said base between a closed position and an open position;

a latch configured to selectively retain said cover in said closed position;

a container component supported at said base;

a release system having a distal end and a proximate end and positionable between a first position and a second position, said release system is integrally molded as a one-piece member with said container component in said first position, wherein said release system is pivotable about said proximate end relative to said container component when in said first position, when in said second position said distal end of said release system is connected to said container component allowing deflection of said release system between said proximate and distal ends relative to said container component to operate said latch; and a retaining mechanism locking said distal end of said release system to said container component when in said second position.

7. The cosmetic compact as in claim 6 wherein said container component is coupled to said base after said release system is in said second position.

8. The cosmetic compact as in claim 6 wherein said container component includes a cutout aperture receiving said release system when in said second fixed position.

9. The cosmetic compact as in claim 6 wherein said release system pivots from said first position to said second position about an axis perpendicular to a pivot axis of said cover relative to said base.

10. The cosmetic compact as in claim 6 wherein said release system includes a latch catch releasably engaging said latch when said release system is in said second position.

11. A container system for retaining a cosmetic article, said system comprising:

a container having a cover movably coupled to a base;

a package supported by said container, said package including a deck and a release system integral with said deck, said release system being rotatable about a hinge along a substantially vertical axis between a first position and a second position;

wherein said release system is formed in said first position and later rotated to said second position;

wherein said release system further includes a first link member and a user interface, said first link member having a first end coupled to said user interface and a second end coupled to said deck at said vertical axis;

wherein said release system includes a second link member having a first end coupled to said user interface and a second end that is free when said release system is in said first position; and wherein said deck includes a retaining mechanism engageable with said second link to assist in retaining said release system in said second position.

12. The system as in claim 11 wherein said release system is rotated about said vertical axis between around 5 degrees and around 90 degrees when moving from said first position to said second position.

13. The system as in claim 11 wherein said second end of said second link member is configured to be positioned proximate said deck when said release system is rotated to said second position.

14. The system as in claim 11 wherein said retaining mechanism is a projection extending outward from said deck.

15. The system as in claim 11 wherein said user interface remains within a first horizontal plane when said release system is rotated from said first position to said second position.

16. The system as in claim 11 wherein said user interface is a push-button device configured to be pressed by a user to selectively move said container to an open position.

17. The system as in claim 11 wherein a living hinge is provided between said second end of said first link member and said deck.

18. The system as in claim 11 wherein said deck includes a flange outwardly extending in a substantially horizontal direction.

19. The system as in claim 18 wherein said flange at least partially conceals said first link member when said release system is rotated to said second position.

20. The system as in claim 18 wherein said flange includes a cutout whereat at least a portion of said user interface is adjacently positioned when said release system is rotated to said second position.

21. The system as in claim 11 wherein said deck is substantially circular in shape and is configured to be supported at said base of said container.

22. The system as in claim 11 wherein said deck defines at least one cavity configured to receive said cosmetic article.

* * * * *